United States Patent [19]

Dotzel et al.

[11] Patent Number: 4,667,596

[45] Date of Patent: May 26, 1987

[54] METHOD OF AUTOMATICALLY SETTING THE COLORS PRINTED OUT BY FLEXOGRAPHIC PRINTING MACHINES FOR FOUR-COLOR PRINTING

[75] Inventors: Klaus P. Dotzel, Gebenstorf, Switzerland; Heinz Eschmeier, Lengerich, Fed. Rep. of Germany

[73] Assignee: Windmoller & Holscher, Lengerich, Fed. Rep. of Germany

[21] Appl. No.: 802,083

[22] Filed: Nov. 27, 1985

Related U.S. Application Data

[63] Continuation of Ser. No. 475,559, Mar. 15, 1983, abandoned.

[30] Foreign Application Priority Data

Mar. 16, 1982 [DE] Fed. Rep. of Germany ..... 3209483

[51] Int. Cl.[4] ..... B41M 1/14; B41F 5/16

[52] U.S. Cl. ..... 101/211; 101/181

[58] Field of Search ..... 101/181, 182, 349, 350, 101/211, 365, 216, 247, 426, 136, 141, 178

[56] References Cited

U.S. PATENT DOCUMENTS 2,969,016 1/1976 Crosfield et al. ..... 101/202

FOREIGN PATENT DOCUMENTS 1255224 1/1961 France ..... 101/247

1458358 11/1976 United Kingdom .

2071573 9/1981 United Kingdom .

*Primary Examiner*—J. Reed Fisher

*Attorney, Agent, or Firm*—Fleit, Jacobson, Cohn & Price

[57] ABSTRACT

A method of automatically setting the colors printed with yellow, magenta, cyan and black printing inks for four-color printing by flexographic printing machines having printing units provided with plate and backing cylinders is characterized in that, to determine the desired color value in a color triangle which serves for color comparison and the corners of which are fixed by the colors yellow, magenta and cyan, the color location is determined for a test grid area which is printed out by all the printing units and in which each of the printing inks participates with a color proportion between about 40% and 60%, that to determine the existing value of the color by densitometric measurement the proportions of printing inks actually present are measured in the test area and the color location of the existing value is determined in the color triangle, that from a comparison of the color locations the departures of the existing values of the color proportions from the desired values are determined for each color, and that the axial spacing of the plate cylinder for the respective color from the backing cylinder is changed according to said departures until the existing and desired values in the triangle coincide.

1 Claim, 1 Drawing Figure

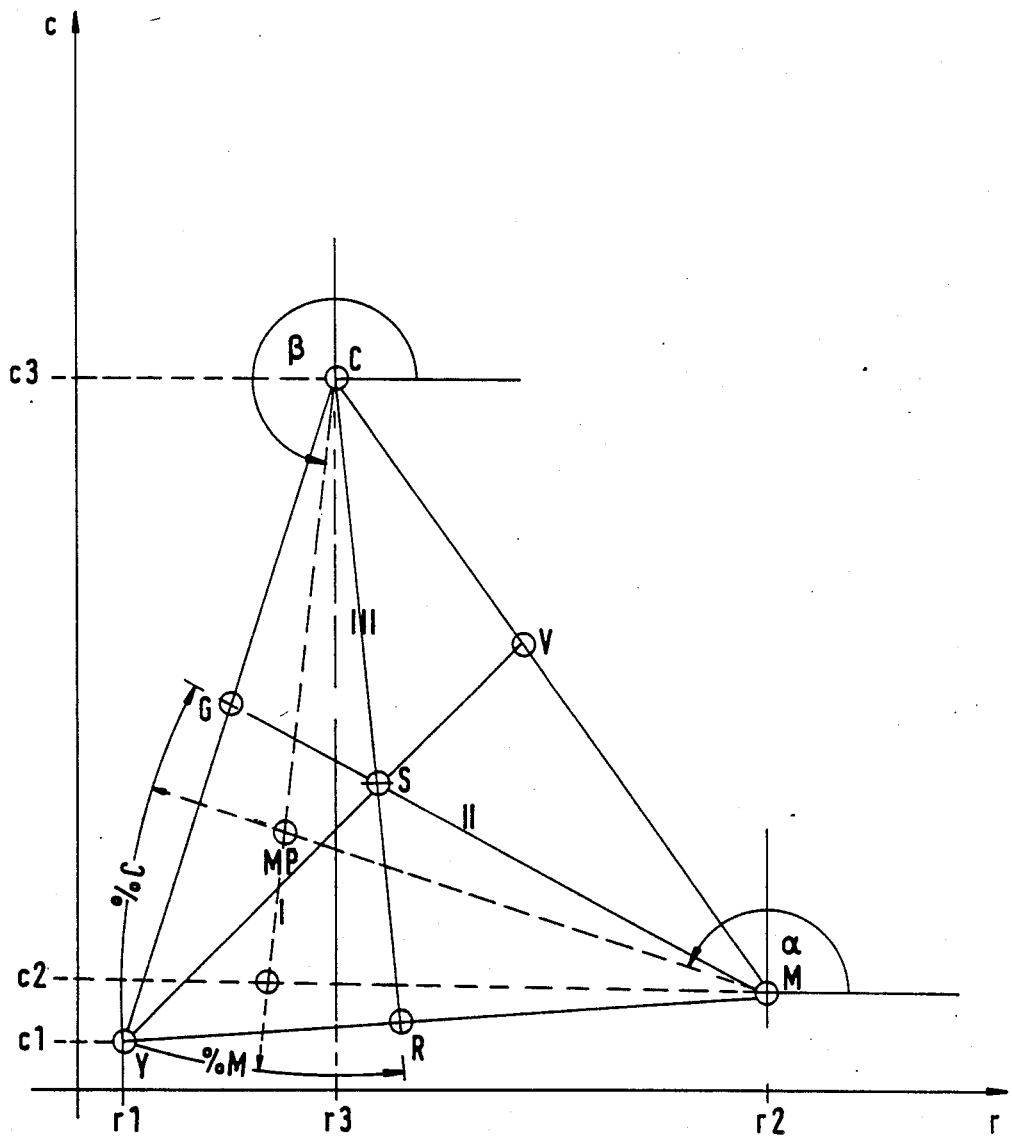
c
c3
c2
c1
β
C
III
V
G
S
II
MP
I
%C
α
M
V
%M
R
r1
r3
r2
r

METHOD OF AUTOMATICALLY SETTING THE COLORS PRINTED OUT BY FLEXOGRAPHIC PRINTING MACHINES FOR FOUR-COLOR PRINTING

This application is a continuation of application Ser. No. 475,559, filed Mar. 15, 1983, now abandoned.

The invention relates to a method of automatically setting the colours printed out with yellow, magenta, cyan and black printing inks for four-colur printing by flexographic printing machines having printing units provided with plate an backing cylinders.

Even if the tint and colour strength of the printing inks are correctly set, in flexographic printing colour displacements can nevertheless occur on account of the individual plate cylinders being applied to the associated backing cylinders at different pressures, so that, by reason of the pressure of application corresponding to the axis spacing between each plate and backing cylinder, the individual dots of the flexible half-tone plate are enlarged and, on the web to be printed, cover an area corresponding to the pressure. The conditions are therefore that the screen dots become enlarged as the axis spacing is less and thus the pressure is larger, whereby an increasingly larger area is covered on the printed material. This causes a variation in the percentage proportion of the colour at the printed area and therefore the tint is changed.

It is therefore the problem of the invention to provide a method by which the printed colours can be set correctly automatically without changing the tint and/or the colour strength of the individual printing inks.

According to the invention, this problem is solved in that, to determine the desired colour value in a colour triangle which serves for colour comparison and the corners of which are defined by the colours yellow, magenta and cyan, the colour location is determined for a test screen area which is printed out by all the printing units and in which each of the printing inks participates with a colour proportion between about 40% and 60%, that to determine the existing value of the colour by densitometric measurement the proportions of printing inks actually present are measured in a test area printed on the web and the colour location of the test area is determined in a colour triangle, that, from a comparison of the colour locations, the departures of the existing values of the colour proportions from the desired values of the colour proportions are determined for each colour, and that the axis spacing of the plate cylinder for the respective colour from the backing cylinder is changed in accordance with the departures until the existing and desired values in the colour triangle coincide.

Before setting the printed colours by the method of the invention, the correct colour tint and strength of the individual inks are set by, for example, the method described in DE-OS 30 07 421. For this purpose, a densitometer with blue, red and green filters is used in known manner to measure each paint box colour, such measurement giving the proportions of complementary colours in the paint box colour that correspond to the original illustration. From the densitometer measurements, one can determine by approximate integration the reflection curve with which the measured colours can be clearly determined.

From the paint box colours, in the present case yellow, magenta and cyan, a triangle of a polar co-ordinate system is formed, of which the zero point is given by the achromatic point. From this achromatic point one can draw vectors to the rectilinear compound lines which bound the triangle, so that the angle of the vector gives the tint or compound colour that can be mixed. The length of the vector is a measure of the chrominance which can be determined by admixing black. The polygonal course of colour or the colour triangle gives the respective colour plane, the colour strength being defined by the length of the perpendicular to the lowermost colour plane of which the zero coordinate point is white. The zero coordinate point of the uppermost colour plane is black. In the aforementioned system, to determine the measured colour, the colour intensity is given by the length of the vector, the tint by the vector angle and the colour strength by the length of the perpendicular and compared with a prescribed desired value. Colour concentrate or diluent is added in the manner mentioned in DE-OS 30 07 421 in accordance with the departure from the desired value.

As soon as the paint box colours have been set according to the originals defining the desired values, the printing colours are set by the method of the invention. For this purpose, in a colour triangle having the corners fixed by the printing inks yellow, magenta and cyan, one first determines the colour location for the desired colour value which a test screen area printed on web by all the printing units must possess. Desirably, this desired colour value is so located in the colour triangle that each of the printing inks participates with a proportion between about 40% and 60%. The proportion of all the inks should be sufficiently high to enable sufficiently large values to be measured.

Determination of the existing value of the colour in the screen test area actually printed is done in known manner by densitometric measurement with red, green and blue filiters, so that the measurement permits one to determine the colour location of the existing value in the previously defined colour triangle. From a comparison of the colour locations, one can determine the departures of the existing values of the colour proportions from the desired values of the colour proportions for each colour. In accordance with the departures, the spacing of the plate cylinder axis of the respective colour from the backing cylinder axis is then varied so that the existing value and desired value are brought to coincide in the colour triangle.

According to a preferred embodiment of the invention, it is provided that, by turning straight lines about the magenta corner and cyan corner of the triangle, the measured existing value of the colour is convertable to the desired value by drawing lines in the colour triangle starting at the corners through the centre of gravity, which corresponds to the black point, and fully covering, with the colour determined by the associated triangle corner, the quadrilaterals defined by the triangle lines which extend from the corners and the lines extended beyond the centre of gravity, that from each line of the quadrilateral that is associated with one colour in the colour triangle and that is formed by the line extended beyond the centre of gravity a reducing colour wedge of the colour of the quadrilateral closed by this line is formed to the opposite corner in the triangle which is determined with this line as the base by a triangle side and the line joining the centre of gravity and the corner, and that the change in the spacing of the plate and backing cylinder axes is determined by the angles swept by the two straight lines from the respective existing value to the desired value. The method described above permits values to be determined and calculated, which are preferably processed by microcomputer so that the colour setting according to the invention can be controlled by microcomputer.

According to another advantageous embodiment, the test screen area is selected to be a section of the printed image that corresponds to a selected desired value with a colour distribution as uniform as possible. Such suitable test screen areas can be found in all printed pictures, so that one need not provide a separate test screen area but can carry out the densitometric measurements in the printed picture to determine the existing value.

In the method of the invention, the corners of the triangle need not be defined by the primary colours; they could be other colours.

The invention will now be described in more detail with reference to the drawing, in which the single FIGURE illustrates the colour triangle.

The tint to be achieved on the material to be printed is determined by the colouristic properties of the printing ink and its concentration. Experience shows that the tint for high quality four-colour screen or dot pattern printing must be disposed in very particular zones. The corresponding tint values and colour strength as well as the chrominance is determined for each of the printing inks yellow, magenta and cyan.

The tint is here defined as the angle of rotation about the grey axis of the colour circle, the colour strength as the overall density and the chrominance as the spacing of the tint vector from the black central point of the colour circle.

The numerical values can be determined according to the following formulae from the optical densities R, G and B measured behind the red, green and blue filters of the densitometer:

$$\text{Tint} = \text{arctg}\,(c/r) \times 180/\pi$$

$$c = \frac{R}{R+G+B} - 1/3$$

$$r = \frac{G}{R+G+B} - 1/3$$

$$\text{Colour strength} = (R+G+B) \times 10$$

$$\text{Chrominance} = (c^2+r^2)^{\frac{1}{2}} \times 100$$

By calibration, one can determine what additives of particular inks produce which changes in the colour code numbers, e.g.:

For yellow:

Tint number larger than desired value=tint too red.
Additive: yellow, greenish
1 unit corresponds to x gram or dispensing pump strokes.
Tint number less than desired value=tint too green.
Additive: yellow, reddish
1 unit corresponds to x gram or dispensing pump strokes.

For magenta:

Tint number larger than desired value=tint too blue.
Additive: red
1 unit corresponds to x gram or dispensing strokes.
Tint number less than desired value=tint too red.
Additive: magenta, bluish
1 unit corresponds to x gram or dispensing pump strokes.

For cyan:

Tint number larger than desired value=tint too green.
Additive: blue, reddish
1 unit corresponds to x gram or dispensing pump strokes.
Tint number less than desired value=tint too red.
Additive: blue, greenish
1 unit corresponds to x gram or dispensing pump strokes.

The colour strength value depends on the colour concentration. An upward departure from the desired value indicates a higher concentration which can be compensated by adding diluent. A colour strength which is too low is corrected by adding concentrate.

With the concentration of the ink set correctly, the colour strength measured in the overall test area depends on the thickness of the colour layer. This is determined in the inking unit by the application of the screen roller to the plate cylinder, so that setting of the spacing of the axes by appropriate setting motors for the plate and backing cylinders is possible in accordance with the measured colour strength. In four-colour printing, it is also necessary to maintain a particular characteristic pressure curve, i.e. the application of the plate cylinder to the backing cylinder is of particular importance. Because of the elasticity of the flexographic plate, an increase in the pressure of application leads to an enlargement of the screen dot in the impression and hence to an increase in the percentage of the area covered by the dots in the impression. However, this percentage must not considerably exceed or fall below the values prescribed by the reproduction. Otherwise, one obtains undesired colour displacements in the printed impression.

The densities of the printed colours are measured at a test area printed with known dot coverages in the three primary colours and the actual dot coverages are calculated. From the difference between the existing desired values, one obtains the setting commands for the setting motors which set the spacing between the axes of the plate and backing cylinders.

The manner of determining the setting commands for the setting motors will now be described in more detail with reference to the colour triangle Y-M-C. The illustrated colour triangle is created by the printing together of screen wedges in three-colour printing. The corners of the triangle are defined by the three primary colours yellow (Y), magenta (M) and cyan (C). The centre of gravity S of this triangle is the all over superposed printing of the primary colours.

Yellow and cyan are printed over each other over the full area at the dot G, yellow and magenta at dot R and magenta and cyan it dot V, so that G corresponds to the colour green, R to red and V to violet. In the quadrilateal I defined by the corners Y, R, S and G, yellow is printed over the full area, cyan as a screen wedge increasing towards C and magenta increasing towards R.

In the quadrilateral II defined by dots R, M, V and S, magenta is printed over the full area, and yellow and cyan with a corresponding increasing screen wedge. Finally, in the quadrilateral defined by the dots S, V, C and G, cyan is printed over the full area and the two other colours with increasing and decreasing screen wedges, respectively.

It will be evident from the colour triangle that, for example in quadrilateral I the proportion of cyan in the dot pattern is a function of the turning angle $\alpha$ about the magenta dot M and the magenta screen proportion is a function of the turning angle $\beta$ about the cyan dot C. The conditions in the other areas are analagous. Consequently, each dot in the colour triangle is precisely defined by two angular values of straight lines rotatable about the magenta and cyan dots. The corresponding screen coverages can be calculated if the functions are determined experimentally. The rc system of coordinates shown in the drawing is the same as used for determining the figures for tint, colour strength and chrominance. The proportions of screen coverage can thus be determined from the optical densities.

An example of a measurement is given hereunder:

The test screen area has the following desired composition measured at the plate: yellow 48%, magenta 50%, cyan 50%.

However, from the measurement and calculation one obtains the composition: yellow 55%, magenta 52%, cyan 45%.

Conclusion:

Pressure of application in yellow inking unit too high!

Pressure in magenta inking unit within tolerances!

Pressure in cyan inking unit too low!

The differences between the desired and existing values are parameters for the number of pulses for the setting motors to change the distance between the backing and plate cylinders.

In practice, the method is carried out as follows:

The densitometers are installed in the printing press so that the colour optical density of a row of test measuring marks can be scanned during the printing operation. To determine the setting of the paint box colours, yellow, magenta and cyan are printed over the full area and measured.

For setting the colours printed out in the test screen area, the densitometer is used to measure the test screen area in which the colours yellow, magenta and cyan are each present by between about 40% to 60%. The densities measured by the densitometer through the three coloured filters of blue, green and red are then fed to a process control computer.

In the setting up phase, the method described in DE-OS 30 07 421 is used to measure the existing values of tint, colour strength and chrominance for the inking units and the appropriate corrections are made from a comparison with the prescribed desired values.

From the desired and existing value comparison of the screen area coverages determined in the test screen area, one determines the corresponding setting commands for the setting motors for applying the plate cylinder to the backing cylinder. During the setting up phase, the desired standard values are approached until a visual impression gives the desired print-out. The existing values thus achieved are then used as desired standard values for continued printing. During printing, the given desired figures are continuously monitored automatically. The results can be given over a visual display screen. Subsequent control can take place automatically as in the setting up phase.

We claim:

1. A method of maintaining a desired optical color density of a half tone multi-color image printed with yellow, magenta, cyan and black printing inks using a flexographic printing machine and without changing the color strength of the individual inks in respective ink fountains, said method comprising:

(a) selecting a desired standard color image having a desired color density of each of the colors yellow, magenta, and cyan;

(b) measuring the color density of each of the colors yellow, magenta, and cyan in the desired standard color image;

(c) providing yellow, magenta, and cyan flexographic printing inks having a color tint and strength to provide a desired standard printed color image when printed on a desired substrate;

(d) printing a half tone, multicolor print area on the desired substrate in the colors yellow, magenta, and cyan using a flexographic printing machine including a plurality of rotatable flexographic plate cylinders having respective axes of rotation and including flexible surface half tone printing plates for each color, each plate having a plurality of flexible raised dots defining a half tone image, and a plurality of rotatable backing cylinders each having its axis of rotation disposed parallel to a respective plate cylinder and positioned adjacent the respective plate cylinder to cause a plate image carried by the plate cylinder to be printed on the desired substrate when the substrate is passed between respective plate and backing cylinders, the backing cylinders each contacting respective plate cylinders at a contact pressure at which each of the ink colors yellow, magenta, and cyan is present in a test print area of the printed image in a proportion between about 40% and about 60%;

(e) measuring the color density of each of the colors yellow, magenta, and cyan in the test print area;

(f) determining the differences between the respective color densities of each of the colors in the test print area and the color density of each of the colors in the desired standard color image; and (g) adjusting the spacing between the axes of rotation of the backing cylinders and the axes of rotation of respective ones of the plate cylinders for each of the ink colors while maintaining unchanged the tint and color strength of the individual printing inks, to change the contact pressure therebetween and thereby the image areas of the individual flexible dots of the flexible half tone printing plate as printed on the desire substrate, as necessary to bring the color density of the colors in the test print area into substantial coincidence with the color density of the desired standard image.

* * * * *